US008607710B2

(12) United States Patent
Farr

(10) Patent No.: US 8,607,710 B2
(45) Date of Patent: Dec. 17, 2013

(54) CABLE-TOW SYSTEM HAVING A STATIONARY SUPPORT CABLE

(76) Inventor: Jack Farr, Cresson, TX (US)

( * ) Notice: Subject to any disclaimer, the term of this patent is extended or adjusted under 35 U.S.C. 154(b) by 0 days.

(21) Appl. No.: 13/284,264

(22) Filed: Oct. 28, 2011

(65) Prior Publication Data

US 2012/0186483 A1 Jul. 26, 2012

Related U.S. Application Data

(60) Provisional application No. 61/407,807, filed on Oct. 28, 2010, provisional application No. 61/420,055, filed on Dec. 6, 2010.

(51) Int. Cl.
*B61B 11/00* (2006.01)

(52) U.S. Cl.
USPC ..... 104/173.2; 104/173.1; 104/96; 104/112

(58) Field of Classification Search
USPC ..... 104/173.1, 173.2, 112, 115, 174
See application file for complete search history.

(56) References Cited

U.S. PATENT DOCUMENTS

| | | | | |
|---|---|---|---|---|
| 2,608,935 | A * | 9/1952 | Moore et al. | 104/173.2 |
| 2,704,038 | A * | 3/1955 | Horton | 104/173.2 |
| 3,052,470 | A * | 9/1962 | Pomagalski | 472/13 |
| 3,190,646 | A * | 6/1965 | Forsman | 472/13 |
| 3,261,302 | A * | 7/1966 | Forsman | 105/148 |
| 3,338,180 | A * | 8/1967 | Stecker | 104/173.2 |
| 3,376,829 | A * | 4/1968 | Hancock | 104/173.2 |
| 3,407,942 | A * | 10/1968 | Mcintyre et al. | 212/84 |
| 3,561,366 | A * | 2/1971 | Pomagalski | 104/173.2 |
| 3,712,478 | A * | 1/1973 | Rennie et al. | 212/89 |
| 3,743,278 | A * | 7/1973 | Rixen | 472/13 |
| 3,838,647 | A * | 10/1974 | Rixen | 104/53 |
| 4,023,502 | A * | 5/1977 | Elsing | 104/173.2 |
| 4,103,784 | A | 8/1978 | Gonsior | |
| 4,314,511 | A * | 2/1982 | Bogren | 104/173.1 |
| 4,353,307 | A * | 10/1982 | Munson | 104/183 |
| 4,523,525 | A * | 6/1985 | Foster | 104/173.2 |
| 4,782,761 | A * | 11/1988 | Asberg | 104/196 |
| 5,113,768 | A * | 5/1992 | Brown | 104/112 |

(Continued)

FOREIGN PATENT DOCUMENTS

WO WO-2009/015878 A2 2/2009

OTHER PUBLICATIONS

Pelican Rope, "High Strength Floating Rope", available at http://www.pelicanrope.com/dyneema_ropes.html, Oct. 26, 2011, 1 page.

*Primary Examiner* — Jason C Smith
(74) *Attorney, Agent, or Firm* — Winstead PC

(57) ABSTRACT

A cable-tow system including a skiing surface. A drive tower, including a drive pulley, and a support tower, including a return pulley, are positioned on a periphery of the skiing surface. The cable-tow system further includes a stationary support cable spanning a first distance between the drive tower and the support tower. A movable drive cable spans a second distance between the drive pulley and the return pulley. The movable drive cable travels in an orbital fashion between the drive pulley and the return pulley. A truck is connected to the movable drive cable and includes at least one race pulley. The at least one race pulley engages the stationary support cable. A tow rope is connected to the truck and includes a handle for towing a skier. Movement of the movable drive cable moves the truck along a length of the stationary support cable.

11 Claims, 11 Drawing Sheets

(56) References Cited

U.S. PATENT DOCUMENTS

| | | | | |
|---|---|---|---|---|
| 5,192,145 | A | 3/1993 | Rixen et al. | |
| 5,415,106 | A * | 5/1995 | Groskreutz et al. | 104/173.2 |
| 5,439,294 | A | 8/1995 | Rixen et al. | |
| 5,474,270 | A | 12/1995 | Rixen et al. | |
| 6,062,764 | A | 5/2000 | Rixen et al. | |
| 6,152,044 | A * | 11/2000 | Bouvier | 104/173.2 |
| 6,227,708 | B1 | 5/2001 | Rixen et al. | |
| 6,295,936 | B1 * | 10/2001 | Dahlstrom | 104/173.2 |
| 6,360,669 | B1 * | 3/2002 | Albrich | 104/93 |
| 6,505,453 | B1 | 1/2003 | Rixen et al. | |
| 6,553,738 | B1 | 4/2003 | Rixen et al. | |
| 6,886,471 | B2 * | 5/2005 | Rodnunsky | 104/173.2 |
| 7,156,714 | B2 * | 1/2007 | Kian et al. | 441/74 |
| 8,042,474 | B2 * | 10/2011 | Perakis | 104/112 |
| 2005/0160936 | A1 * | 7/2005 | MacDonald et al. | 104/173.1 |
| 2011/0083577 | A1 * | 4/2011 | Tilley | 104/96 |
| 2011/0162917 | A1 * | 7/2011 | Steele et al. | 188/65.2 |
| 2012/0186483 | A1 * | 7/2012 | Farr | 104/173.2 |

* cited by examiner

CABLE-TOW SYSTEM HAVING A STATIONARY SUPPORT CABLE

CROSS-REFERENCE TO RELATED APPLICATIONS

This application claims priority from, and incorporates by reference for any purpose, the entire disclosure of, U.S. Provisional Patent Application No. 61/407,807, filed Oct. 28, 2010 and U.S. Provisional Patent Application No. 61/420,055 filed, Dec. 6, 2010.

BACKGROUND

1. Field of the Invention

This application relates generally to cable-tow systems and more particularly, but not by way of limitation, to cable-tow systems utilizing a stationary support cable under high tension and a moving drive cable under low tension.

2. History of the Related Art

Water sports such as, for example, waterskiing, wakeboarding, and the like are popular recreational activities. However, pursuit of these activities can be difficult due to prohibitive expenses associated with required auxiliary equipment. Most notably, participation in most water sports generally requires the use of a boat, purchase, maintenance, and storage of which involves a considerable expense. Furthermore, good safety practices dictate that participation in water sports such as, for example, waterskiing or wakeboarding requires an experienced driver and spotter positioned in a rear region of the boat in addition to a skier. In addition, the boat, when moving at a requisite speed for waterskiing or wakeboarding, causes turbulent surface conditions in a body of water thereby increasing a level of difficulty and potential safety risk.

Cable-tow systems have been developed to allow skiers to enjoy water sports without a need for a boat. Cable-tow systems are typically disposed around a body of water and involve circulating highly tensioned cables in an orbital fashion. The requisite tensioning of moving cables presents several maintenance and safety problems.

SUMMARY

The present invention relates generally to cable-tow systems. In one aspect the present invention relates to a cable-tow system. The cable-tow system includes a skiing surface. A drive tower is positioned on a periphery of the skiing surface. The drive tower has a drive pulley. A support tower is positioned on the periphery of the skiing surface. The support tower has a return pulley. The cable-tow system further includes a stationary support cable spanning a first distance between the drive tower and the support tower. A movable drive cable spans a second distance between the drive pulley and the return pulley. The movable drive cable travels in an orbital fashion between the drive pulley and the return pulley. A truck is connected to the movable drive cable and includes at least one race pulley. The at least one race pulley engages the stationary support cable. A tow rope is connected to the truck and includes a handle for towing a skier. Movement of the movable drive cable moves the truck along a length of the stationary support cable.

In another aspect, the present invention relates to a cable-tow system. The cable-tow system includes a drive tower and at least two support towers. A stationary support cable spans a distance between the drive tower and the at least two support towers in a sequential fashion. The stationary support cable defines a substantially polygonal path. A movable drive cable travels in an orbital fashion around the polygonal path. A corner assembly is associated with each of the drive tower and the at least two support towers. Movement of the drive cable moves a truck along a length of the support cable.

In another aspect, the present invention relate to a method of constructing a cable-tow system. The method includes assembling a drive tower over a skiing surface, assembling at least one support tower over the skiing surface, and arranging a stationary support cable between the drive tower and the at least one support tower. The method further includes tensioning the stationary support cable, arranging a movable drive cable between the drive tower and the at least one support tower, and coupling the movable drive cable to a motor. The method further includes positioning a truck on the stationary support cable and connecting the truck to the movable drive cable.

BRIEF DESCRIPTION OF THE DRAWINGS

A more complete understanding of the method and system of the present invention may be obtained by reference to the following Detailed Description when taken in conjunction with the accompanying Drawings wherein.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1:
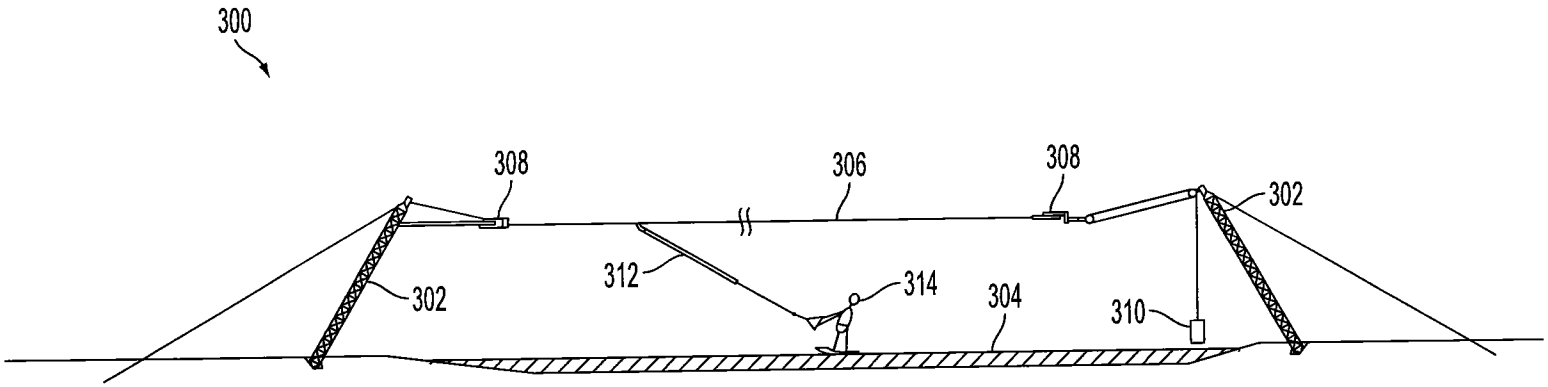
FIG. 1 PRIOR ART
FIG. 1 is a schematic diagram of a prior-art cable-tow system.

FIG. 1 is a schematic diagram of a prior-art cable-tow system. A prior-art cable-tow system 300 includes at least two towers 302 erected around a periphery of a body of water 304. Each tower of the at least two towers 302 inlcudes a pulley 308 associated therewith. A cable 306 is wound around the pulleys 308 associated with each tower of the at least two towers 302. At least one counter-weight 310 is used to place the cable 306 under substantial tension, usually on an order of 5,000 to 6,000 pounds. In operation, the cable 306 travels around the pulleys 308 in a substantially circular fashion. Tow ropes 312 are attached to the cable 306 and pull riders 314 around the body of water 304.

The cable-tow system 300 as illustrated in FIG. 1 has certain drawbacks. First, due to the arrangement of the cable 306, the riders 314 are limited to a generally circular path of travel. That is, a typical cable-tow course will comprise either all right turns or all left turns depending on a direction of travel. In addition, such an arrangement does not allow changes in elevation of the cable 306 to be added to a cable-tow course.

Second, the cable-tow system 300 presents many difficulties associated with maintenance. For example, the high degree of tensioning of the cable 306 can result in the cable 306 to becoming dislodged from the pulleys 308. This often results in serious damage to the cable-tow system 300 as well as possible injury to the riders 314. Next, the cable-tow system 300 requires large amounts of mechanical power to overcome friction and inertia associated with various cable-tow system components such as, for example, the pulleys 308. Finally, the cable-tow system 300 is expensive and difficult to install.

The majority of the problems associated with the cable-tow system 300 may be alleviated by providing an exemplary cable-tow system having, for example, a stationary high-tension support cable and a low-tension movable drive cable.

Figure 2:
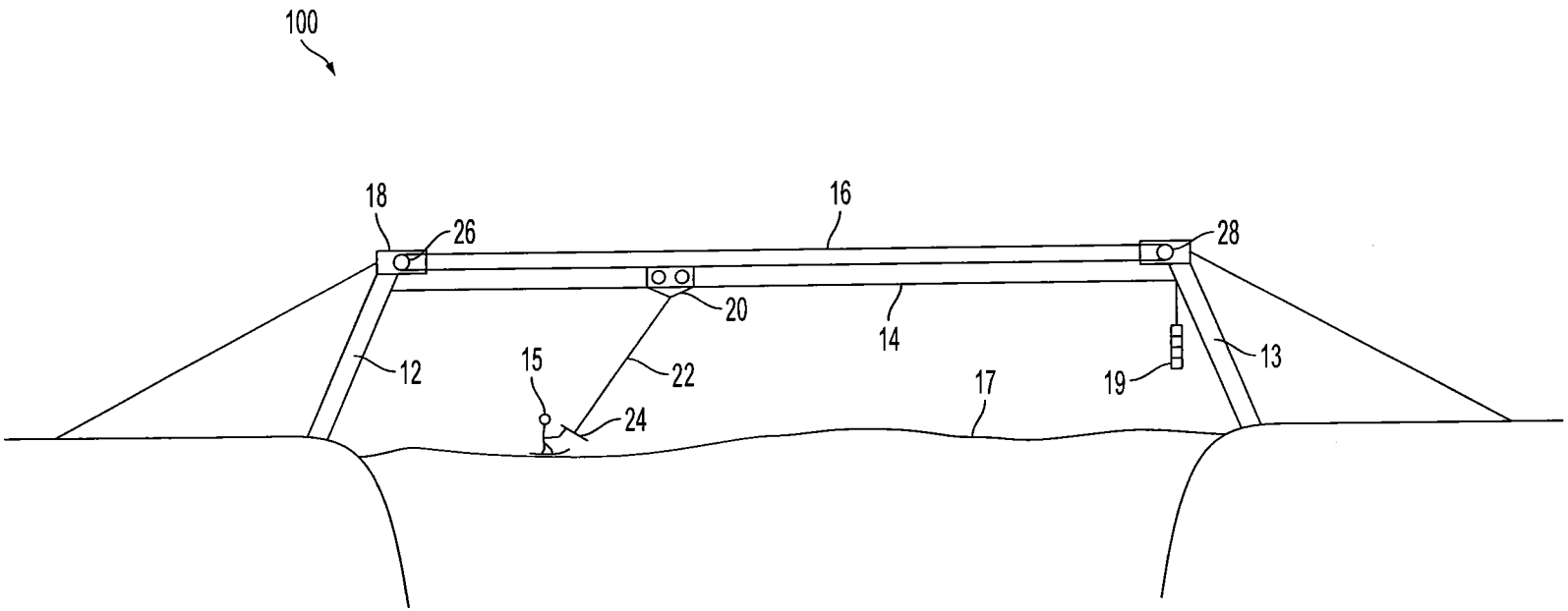
FIG. 2 is a side view of a cable-tow system according to an exemplary embodiment.

FIG. 2 is a schematic diagram of a cable-tow system according to an exemplary embodiment. An exemplary cable-tow system 100 includes a drive tower 12, a support tower 13, a support cable 14, and a drive cable 16. In various embodiments, the support cable 14 and the drive cable 16 are, for example, steel cables; however, in various alternative embodiments, other materials may be utilized such as, for example, nylon, polyester, aluminum, or other metallic or synthetic materials. In an exemplary embodiment, the support cable 14 and the drive cable 16 are each synthetic cables such as, for example, Dyneema® high-strength rope available from Pelican Rope Works of Santa Ana, Calif.

Still referring to FIG. 2, a motor 18 is mounted to a top region of the drive tower 12. The support cable 14 is connected to both the drive tower 12 and the support tower 13 and spans a distance between the drive tower 12 and the support tower 13. In a typical embodiment, the support cable 14 is tensioned to approximately 4,000 to approximately 6,000 pounds. By way of example, the support cable 14 is shown in FIG. 2 as being tensioned by a counterweight 19; however, one skilled in the art will recognize that the support cable 14 may be tensioned through any appropriate means. The tension applied to the support cable 14 allows the support cable 14 to support the weight of at least one skier 15. A truck 20 is engaged with the support cable 14 and is free to move along a length of the support cable 14 in either direction. A tow rope 22 having a handle 24 is attached to the truck 20. The at least one skier 15 holds the handle 24 while being towed across a skiing surface 17. The skiing surface 17 is most often a surface of a body of water; however, one skilled in the art will recognize that the skiing surface 17 may be, for example, snow or any variety of synthetic skiing surface.

Figure 3:
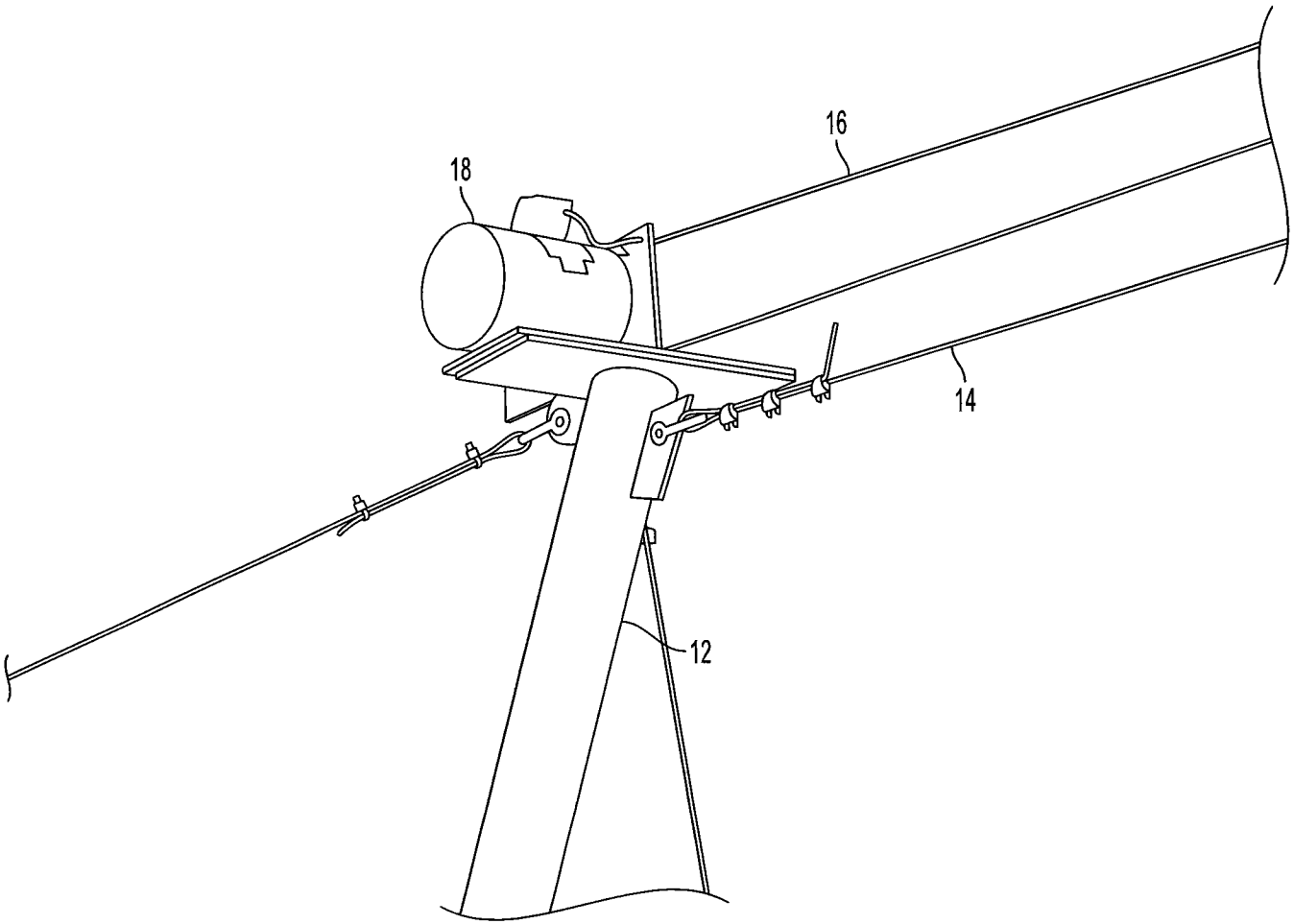
FIG. 3 is a left perspective view of a drive tower according to an exemplary embodiment.
Figure 4:
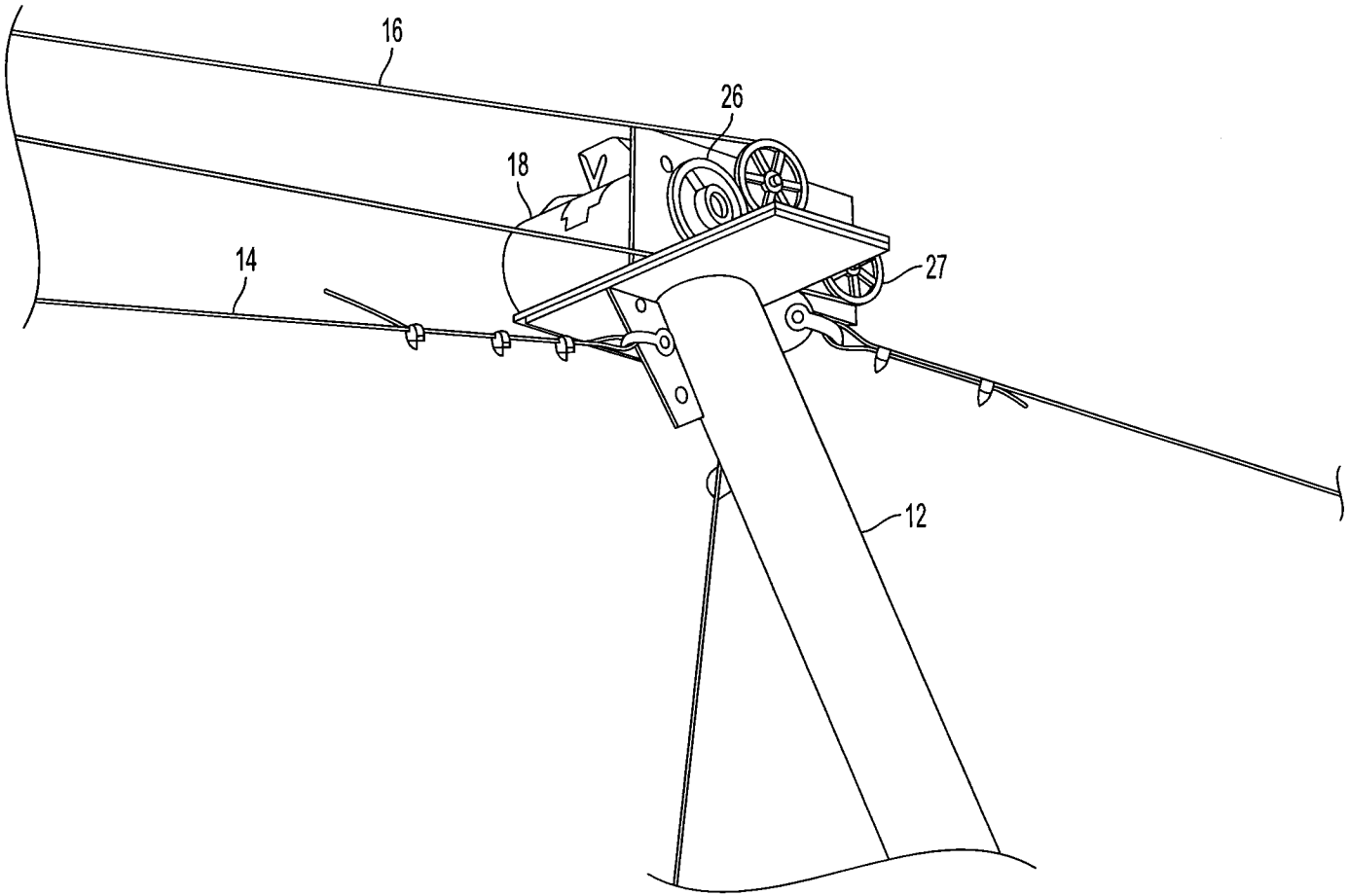
FIG. 4 is a right perspective view of the drive tower of FIG. 3 according to an exemplary embodiment.

FIG. 3 is a left perspective view of a drive tower according to an exemplary embodiment. FIG. 4 is a right perspective view of the drive tower of FIG. 3 according to an exemplary embodiment. Referring now to FIGS. 2-4, the drive tower 12 includes at least one drive pulley 26 mounted thereto. The at least one drive pulley 26 is connected to the motor 18. Similarly, at least one return pulley 28 is mounted to a top of the support tower 13. The embodiments illustrated in FIGS. 2-4 show one drive pulley 26 and one return pulley 28; however, one skilled in the art will recognize that any number of drive pulleys 26 and return pulleys 28 may be utilized. In various embodiments, at least one idler pulley 27 may be used with the at least one drive pulley 26. The drive cable 16 is formed in a generally-circular configuration. The drive cable is looped around the at least one drive pulley 26 and the at least one return pulley 28. The drive cable is operatively coupled to the truck 20. In a typical embodiment, the drive cable 16 is kept under minimal tension thereby reducing a required thickness of the drive cable 16.

Figure 5:
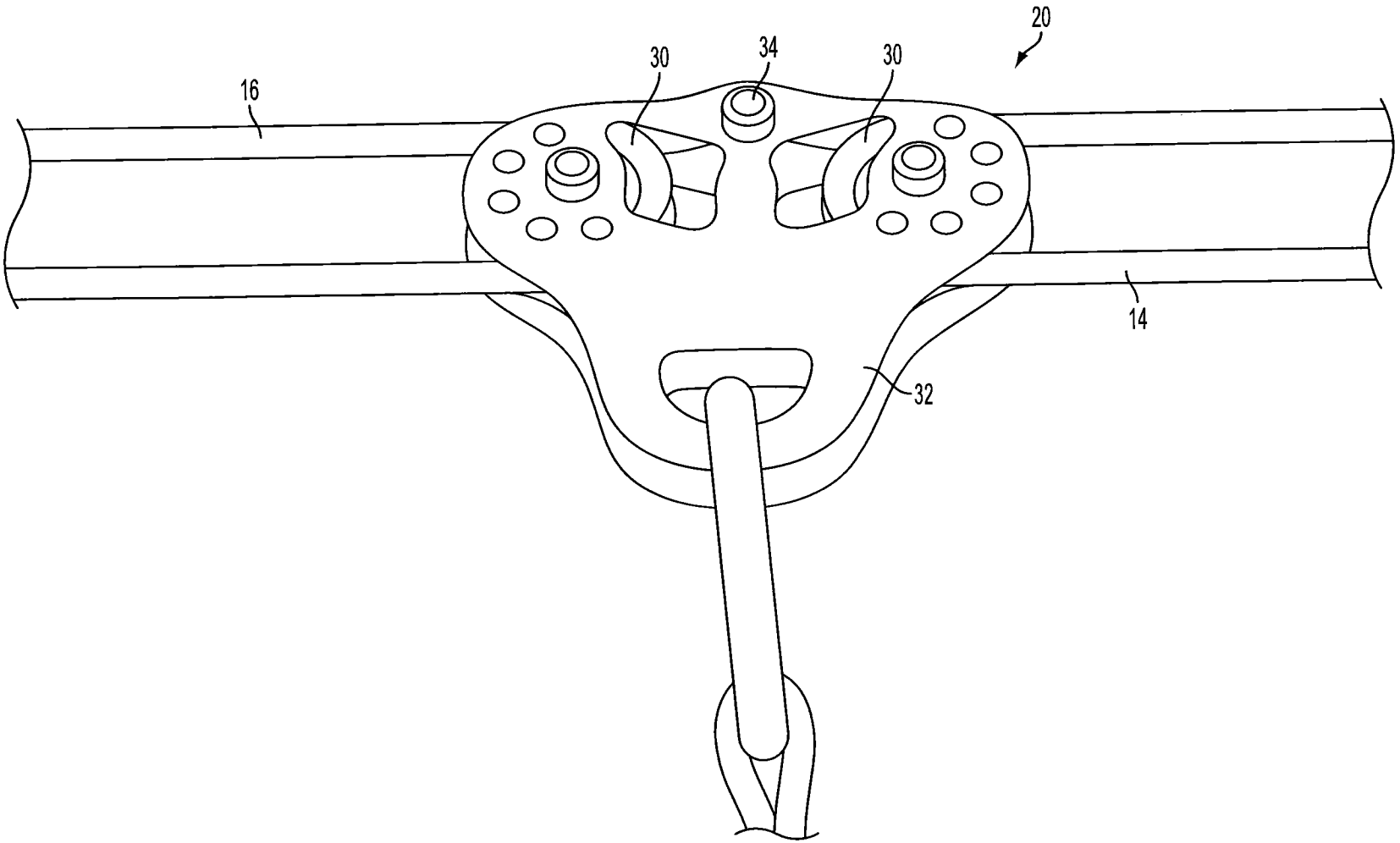
FIG. 5 is a front view of a truck according to an exemplary embodiment.

FIG. 5 is a front view of a truck according to an exemplary embodiment. The truck 20 includes at least one race pulley 30 and a body assembly 32. The truck 20 is depicted by way of example in FIG. 5 as having two race pulleys 30; however, one skilled in the art will recognize that any number of race pulleys 30 may be utilized. The at least one race pulley 30 engages the support cable 14 thereby allowing the truck 20 to freely travel along the length of the support cable 14. A linkage 34 is connected to the body assembly 32. The linkage 34 connects the truck 20 with the drive cable 16. The linkage 34 is depicted in FIG. 5 as being a rigid connection; however, in various alternative embodiments, the linkage 34 may be, for example, any type of rigid, flexible, or removable connection. In various embodiments, the linkage 34 includes a carabiner-type connection, a cotter-pin connection, a friction engagement, a welded connection, or the like.

Referring to FIGS. 2-5, during operation, the truck 20 is initially positioned near the drive tower 12; however, one skilled in the art will recognize that the truck 20 may be initially positioned near the support tower 13 with minimal change to operation. The at least one skier 15 holds the handle 24. Once power is supplied to the motor 18, the motor 18 turns the at least one drive pulley 26 causing the drive cable 16 to move in a substantially orbital fashion between the at least one drive pulley 26 and the at least one return pulley 28. Movement of the drive cable 16 imparts force to the truck 20 by way of the linkage 34 thereby inducing the truck 20 to move along the length of the support cable 14. Motion of the truck 20 causes the at least one skier 15 to be towed across the skiing surface 17.

Still referring to FIGS. 2-5, upon arriving at the support tower 13, power to the motor 18 is turned off causing movement of the drive cable 16 and the truck 20 to cease. In a typical embodiment, inertia of the at least one skier 15 allows the at least one skier 15 to make a substantially 180 degree turn while still holding the handle 24. Once the at least one skier 15 has completed the 180 degree turn, power is again supplied to the motor 18; however, the direction of the motor 18 is reversed. The motor 18 causes the drive cable 16 to travel in a reverse direction thereby moving the truck 20 toward the drive tower 12. The at least one skier 15 will thus be towed towards the drive tower 12. In a typical embodiment, this process can then be repeated so long as desired.

Figure 6:
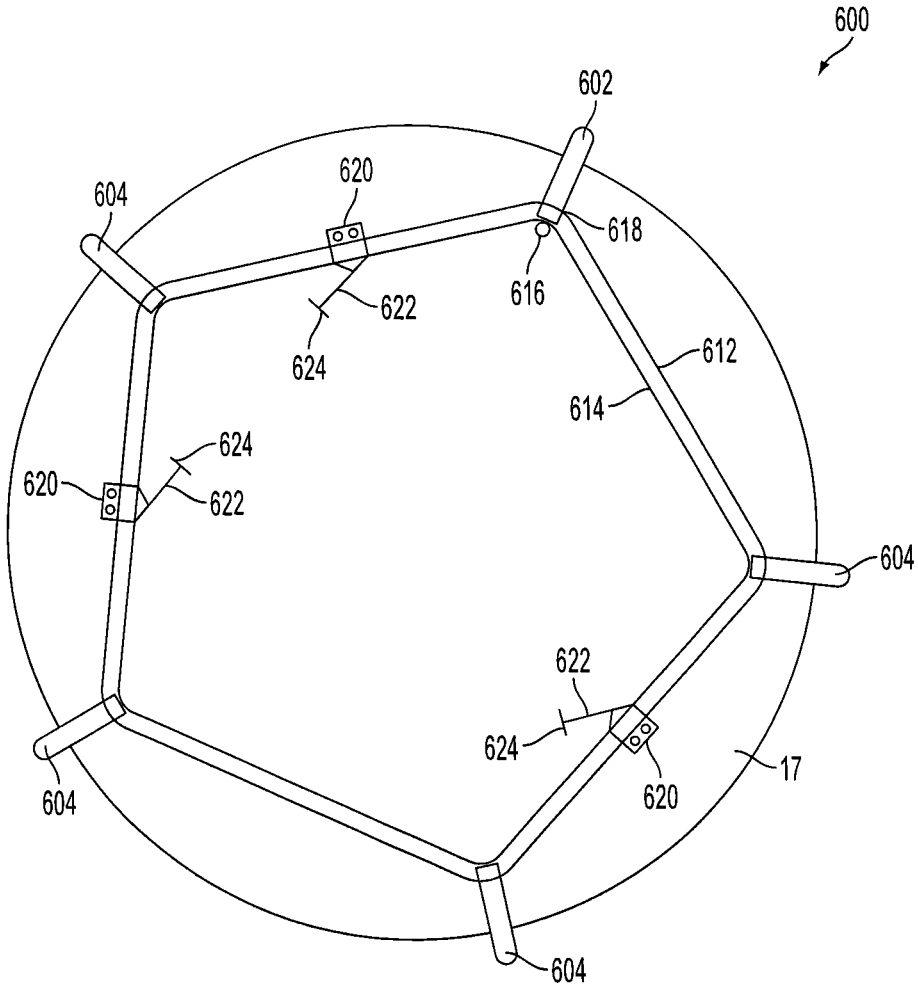
FIG. 6 is a top view of a cable-tow system according to an exemplary embodiment.

FIG. 6 is a top view of a cable-tow system according to an exemplary embodiment. A cable-tow system 600 includes a drive tower 602, a plurality of support towers 604, a support cable 612, a drive cable 614, and a motor 616. The drive tower 602 and the plurality of support towers 604 are positioned around a periphery of the skiing surface 17. The cable-tow system 600 is shown by way of example in. FIG. 6 as having four support towers 604; however, one skilled in the art will recognize that the plurality of support towers 604 may include any number of support towers 604. The support cable 612 is stretched sequentially between the drive tower 602 and each support tower of the plurality of support towers 604 thereby creating a substantially polygonal path. In a typical embodiment, tension applied to the support cable 612 is in a range of approximately 4,000 to approximately 6,000 pounds. As discussed above, tension applied to the support cable 612 allows the support cable 612 to support a weight of the at least one skier 15 (shown in FIG. 2).

Still referring to FIG. 6, in a typical embodiment, the drive cable 614 is positioned slightly below the support cable 612; however, the drive cable 614 may be positioned in a number of configurations relative to the support cable 612 including, for example, side-by-side or slightly above. A truck 620 is positioned on the support cable 612 and connected to the drive cable 614. The cable-tow system 600 is shown in FIG. 6 as having three trucks 620 associated therewith; however, one skilled in the art will recognize that any number of trucks 620 could be utilized. A corner assembly 618 is disposed at the drive tower 602 and each support tower of the plurality of support towers 604. In a typical embodiment, the corner assembly 618 supports the support cable 612 and guides the truck 620 around turns. A tow rope 622 is removably attached to each truck 620. The tow rope 622 has a handle 624 associated therewith.

Figure 7:
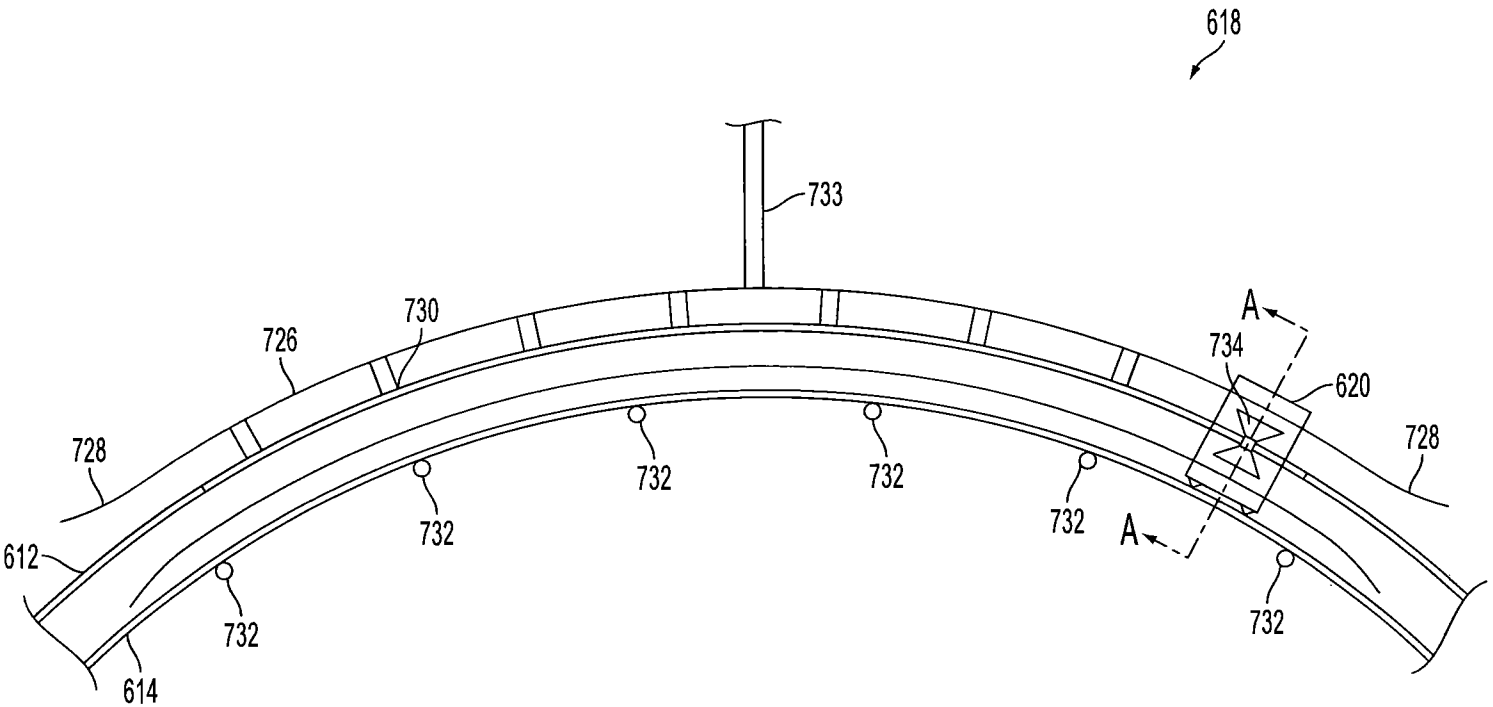
FIG. 7 is a top view of a corner assembly according to an exemplary embodiment.

FIG. 7 is a top view of a corner assembly of FIG. 6 according to an exemplary embodiment. The corner assembly 618 includes a track 726 having flared ends 728, a cable support 730, and a plurality of rollers 732. The track 726 is formed into an arc-shape with a radius substantially equivalent to a radius of a turn. The cable support 730 is positioned in the middle of the track 726 and supports the support cable 612. In a typical embodiment, the cable support 730 does not interfere with passage of a race pulley 734 over the support cable 612. In a typical embodiment, the track 726 directs the truck 620 around the turn. The plurality of rollers 732 direct the drive cable 614 around the turn. The corner assembly 618 is connected to the drive tower 602 and each support tower of the plurality of support towers 604 by a tensioning cable 733. However, one skilled in the art will recognize that, in various alternative embodiments, any type of rigid, flexible, or removable connections may be utilized.

Figure 8:
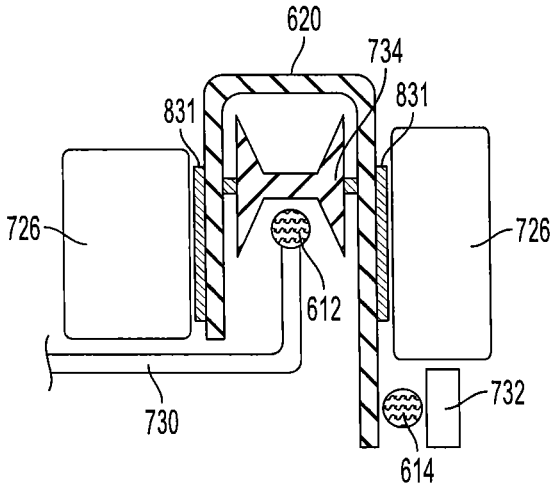
FIG. 8 is a cross-sectional view, taken about section line A-A, of the corner assembly of FIG. 7 according to an exemplary embodiment.

FIG. 8 is a cross-sectional view of the corner assembly of FIG. 7 according to an exemplary embodiment. The race pulley 734 associated with the truck 620 can be seen engaged with the support cable 612. As discussed above, the support cable 612 is positioned in the approximate center of the track 726 and is supported by the cable support 730. Bearings 831 are disposed on opposing sides of the truck 620. In a typical embodiment, the bearings 831 reduce friction between the truck 620 and the track 726. The cable support 730 is shown in FIG. 8 as being arranged at a 90° angle; however, one skilled in the art will recognize that, in various alternative embodiments, the cable support 730 may be arranged at any appropriate angle. For example, in various embodiments, the cable support 730 could be arranged at an angle much less than 90 degrees. The plurality of rollers 732 are shown disposed near a bottom portion of the track 726. The plurality of rollers 732 direct the drive cable 614 around the turn.

Referring now to FIGS. 6-8, during operation, the tow rope 622 is initially disengaged from the truck 620 and is positioned near the drive tower 602; however, the initial positioning of the tow rope 622 is not critical to the operation of the cable-tow system 600. The tow rope 622 is positioned near the drive cable 614 in such a manner as to allow the tow rope 622 to be engaged by the truck 620 as the truck 620 passes near the tow rope 622. Power is supplied to the motor 616. The motor 616 causes the drive cable 614 to travel around the substantially polygonal path defined by the drive tower 602 and the plurality of support towers 604. The drive cable 614 imparts a force to the truck 620 thereby inducing the truck 620 to move along the length of the support cable 612. The truck 620 encounters and engages the tow rope 622 thereby inducing the tow rope 622 to move with the truck 620. The at least one skier 15 (shown in FIG. 2) holds the handle 624 of the tow rope 622. Motion of the truck 620 causes the at least one skier 15 to be towed across the skiing surface 17.

Still Referring to FIGS. 6-8, upon reaching one of the drive tower 602 or the plurality of support towers 604, the race pulley 734 is captured by the flared ends 728 of the track 726. The track 726 stabilizes the truck 620 and directs the truck 620 around the turn. This process can be repeated as long as desired.

The cable-tow system 600 as shown and described above includes several advantages. First, since the highly-tensioned support cable 612 is stationary, the cable-tow system is not subject to the same degree of wear associated with prior-art systems having a moving cable under high tension. Further, because the support cable 612 is fixed, there is little risk of the support cable 612 becoming dislodged during operation. This reduces risk of equipment damage and personal injury. The advantages associated with the cable-tow system 600 are also associated with the cable-tow system 100.

Figure 9:
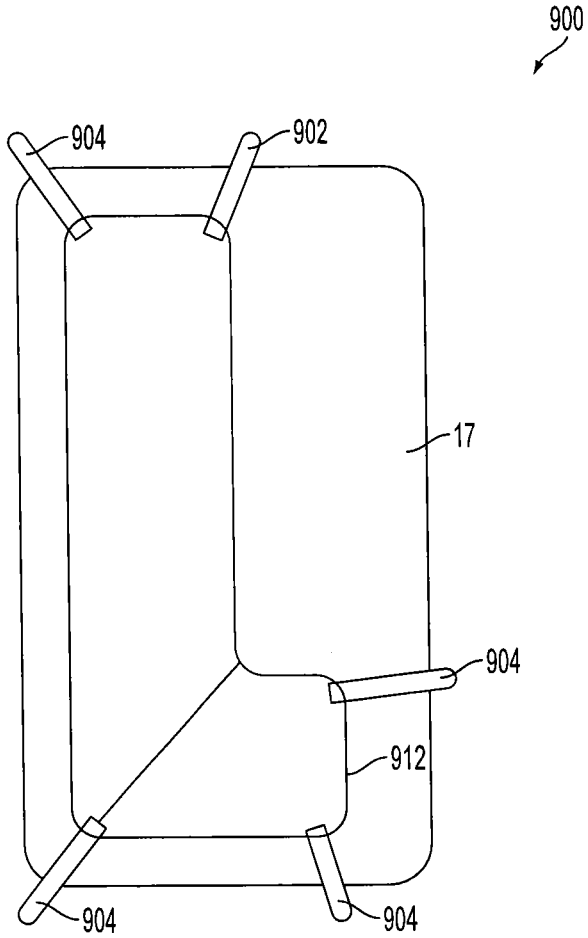
FIG. 9 is a top view of an alternate cable-tow system according to an exemplary embodiment.

FIG. 9 is a schematic diagram of an alternate cable-tow system according to an exemplary embodiment. The cable-tow system 900 includes a drive tower 902 and a plurality of support towers 904. A support cable 912 spans a distance between the drive tower 902 and each support tower of the plurality of support towers 904. A drive cable (not explicitly shown) also spans a distance between the drive tower 902 and each support tower of the plurality of support towers 904. The drive cable is connected to a motor (not explicitly shown). The drive tower 902 and the plurality of support towers 904 are arranged around a periphery of the skiing surface 17. As illustrated in FIG. 9, the cable-tow system 900 allows for both right and left turns to be utilized. This allows the cable-tow system 900 to be arranged in a variety of patters such as, for example, "L" shaped or an irregular polygon. In addition, the cable-tow system 900 allows for turns of varying radii. In many prior-art systems, the radii of turns are limited by the size of available pulleys. Due to manufacturing constraints, this commonly results in turns of a small radius. In the cable-tow system 900, the track 126 (shown in FIGS. 7-8) may be formed into any desired radius. This affords the ability to construct a course with wide turns ideal for beginner-level skiers.

Figure 10:
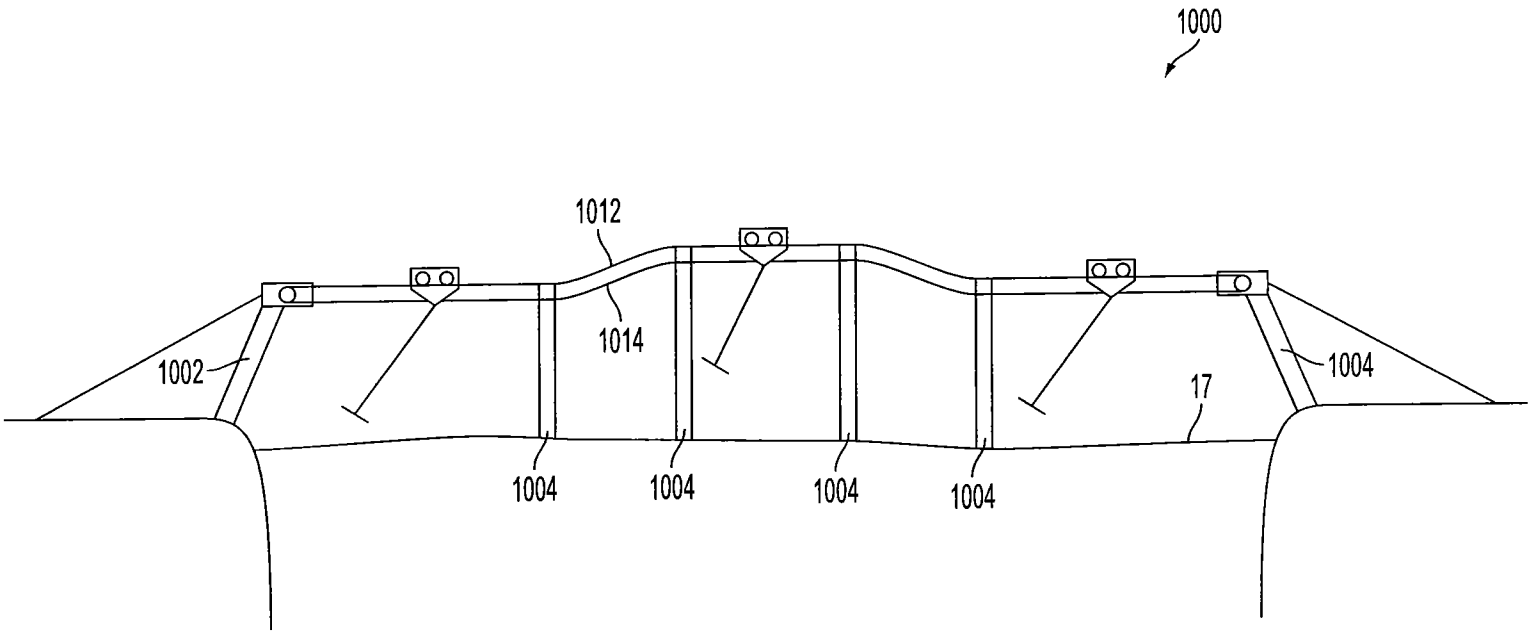
FIG. 10 is a side view of a cable-tow system according to an exemplary embodiment.

FIG. 10 is a schematic diagram of a cable-tow system according to an exemplary embodiment. The cable-tow system 1000 includes a drive tower 1002 and a plurality of support towers 1004. The drive tower 1002 and the plurality of support towers 1004 are arranged around a periphery of the skiing surface 17. A support cable 1012 and a drive cable 1014 are arranged to span a distance between the drive tower 1002 and the plurality of support towers 1004. As illustrated in FIG. 10, the cable-tow system 1000 allows for changes in elevation of the support cable 1012 and the drive cable 1014 to be incorporated.

Figure 11:
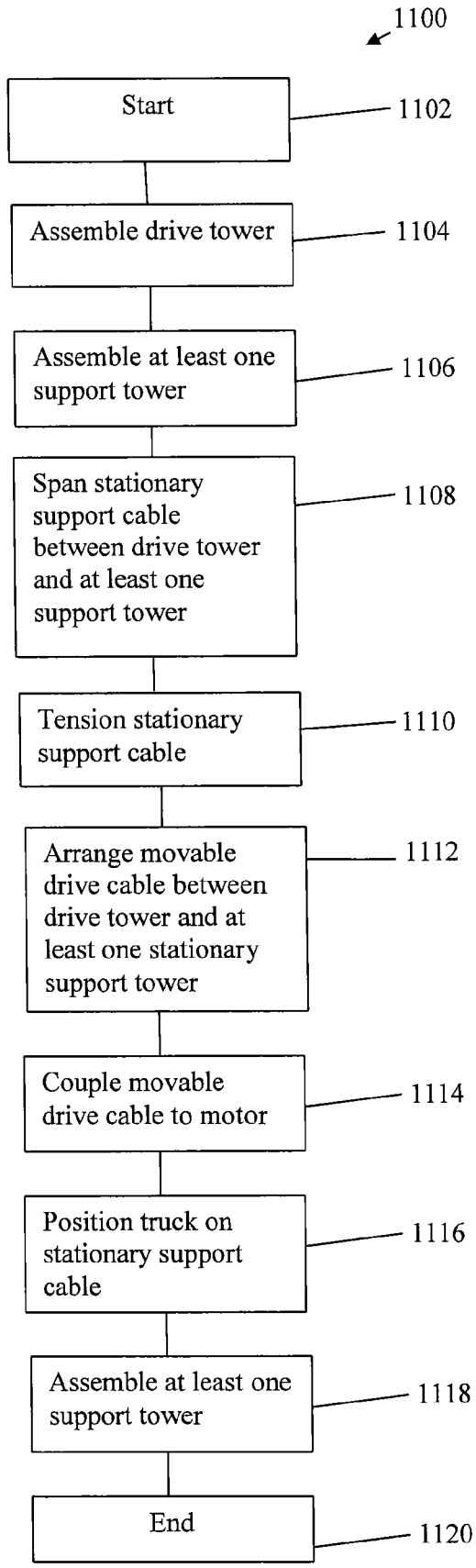
FIG. 11 is a flow diagram of process for constructing a cable tow system according to an exemplary embodiment.

FIG. 11 is a flow diagram of process for constructing a cable tow system according to an exemplary embodiment. A process 1100 begins at step 1102. At step 1104, a drive tower is assembled above a skiing surface on a periphery of the skiing surface. At step 1106, at least one support tower is assembled above the skiing surface on the periphery of the skiing surface. At step 1108, a stationary support cable is arranged between the drive tower and the at least one support tower. At step 1110, the stationary support cable is tensioned to a range of approximately 4,000 pounds to approximately 6,000 pounds. At step 1112, a movable drive cable is arranged between the drive tower and the at least one support tower. At step 1114, the movable drive cable is coupled to a motor. At step 1116, a truck is positioned on the stationary support cable. At step 1118, the truck is connected to the movable drive cable. The process 1100 ends at step 1120.

Although various embodiments of the method and system of the present invention have been illustrated in the accompanying Drawings and described in the foregoing Specification, it will be understood that the invention is not limited to the embodiments disclosed, but is capable of numerous rearrangements, modifications, and substitutions without departing from the spirit and scope of the invention as set forth herein. It is intended that the Specification and examples be considered as illustrative only.

What is claimed is:

1. A cable-tow system comprising:

a drive tower;

at least two support towers;

a stationary support cable spanning a distance between the drive tower and the at least two support towers in a sequential fashion thereby defining a substantially polygonal path;

a truck comprising a race pulley, the race pulley being engaged with the stationary support cable;

a movable drive cable traveling in an orbital fashion around the polygonal path;

a corner assembly associated with each of the drive tower and the at least two support towers, the corner assembly comprising:

an arc-shaped track;

a cable support disposed in the arc shaped track and coupled to the stationary support cable; and a plurality of rollers associated with the arc-shaped track, the plurality of rollers engaged with the movable drive cable, wherein the plurality of rollers direct the movable drive cable around a turn; and wherein movement of the drive cable moves the truck along a length of the stationary support cable.

2. The cable-tow system of claim 1, wherein the arc-shaped track directs the truck around a turn.

3. The cable-tow system of claim 1, wherein the arc-shaped track comprises a pair of flared ends for receiving the truck.

4. The cable-tow system of claim 1, wherein each of the stationary support cable and the movable drive cable are synthetic cables.

5. The cable-tow system of claim 1, wherein an elevation of the stationary support cable and the movable drive cable changes between the at least two support towers.

6. A method of constructing a cable-tow system, the method comprising:

assembling a drive tower over a skiing surface;

assembling at least one support tower over the skiing surface;

arranging a stationary support cable between the drive tower and the at least one support tower;

tensioning the stationary support cable;

arranging a movable drive cable between the drive tower and the at least one support tower;

directing the drive cable through a corner assembly via a plurality of rollers, the plurality of rollers being associated with an arc-shaped track;

coupling the movable drive cable to a motor;

positioning a truck on the stationary support cable such that a race pulley engages the stationary support cable; and connecting the truck to the movable drive cable.

7. The method of claim 6, wherein the tensioning comprises applying tension in a range of approximately 4,000 pounds to approximately 6,000 pounds to the stationary support cable.

8. The method of claim 7, wherein the tensioning comprises applying tension via a counterweight assembly.

9. The method of claim 6, further comprising assembling a corner assembly to each of the drive tower and the at least one support tower.

10. The method of claim 6, wherein the skiing surface is water.

11. The method of claim 6, further comprising imparting motion to the truck via the movable drive cable.

* * * * *